United States Patent [19]

Stout

[11] 3,934,104

[45] Jan. 20, 1976

[54] PUSH-BUTTON SWITCH

[76] Inventor: Glenn M. Stout, 2000 Argonne Drive, Minneapolis, Minn. 55422

[22] Filed: Sept. 23, 1974

[21] Appl. No.: 508,228

[52] U.S. Cl. ..... 200/159 R; 200/314

[51] Int. Cl.[2] ..... H01H 13/50

[58] Field of Search..... 200/159 R, 314, 280, 281

*Primary Examiner*—Robert K. Schaefer
*Assistant Examiner*—William J. Smith
*Attorney, Agent, or Firm*—Schroeder Siegfried Ryan & Vidas

[57] ABSTRACT

A push-button electric switch particularly adapted for use in printed circuit boards in which the base member has a plurality of terminals thereon and the actuating plunger may incorporate one or more bridging contact members which cooperate with the terminals to provide varying switching configurations, such as a single pole, single throw switch or double pole, double throw switch. The base is keyed to the actuating plunger and housing so that the housing and plunger may be assembled on the base in either one of two positions to provide with a single bridging contact in either one of two configurations with respect to the terminals connecting to the printed circuit board. The assembly provides for a recessed or hollow operating shaft of the plunger and an upstanding post on the base member for providing a mounting for an illumination light for key top illumination and permitting connection of the electric conductors from the illumination light through the base member to the printed circuit board.

19 Claims, 10 Drawing Figures

PUSH-BUTTON SWITCH

My invention relates to an electric push-button switch, and more particularly to an improved switch of this type adapted for many types of mounting, such as on a printed circuit board or to a connector, and which facilitates change of the contact configuration therein without a removal of the switch from the mounting means.

Electric switches of the push button type particularly adapted for use on printed circuit boards are known and in use. Normally, such structures are assembled on the circuit boards by means of nut and bolt configurations, riveting, or soldering and provide a permanent installation which is not subject to alteration without removal of the complete switch. Such switch designs are fixed in design with respect to contact configuration and circuit and cannot be altered without removal of the switch and substitution of a different switch. A typical switch of this type is shown in the Brevick U.S. Pat. No. 3,701,060 entitled PUSH-BUTTON SWITCH FOR MOUNTING ON PRINTED CIRCUIT BOARDS, dated Jan. 9, 1973.

The invention herein is directed to a push-button switch of the type shown in the above referenced Brevick patent with modifications which permits the actuating plunger and cover to be assembled on the base of the switch in either of two ways, to provide for either a single or double pole, single throw switch configuration or a triple pole, single throw switch configuration. For binary encoding, the switch base may be installed on a printed circuit board through eyelets and riveting of the base of the switch to the printed circuit board or on any other base upon which it is to be mounted. The actuating plunger, housing and base are keyed in relationship to each other in such a manner to permit the plunger and housing to be assembled on the base in either of two positions to provide the different circuit configurations; and the actuating plunger may incorporate one or two contact plates to provide for the variations in the circuitry of the switch. The improved switch design incorporates bifurcated contact wiping blades for a wiping action with button type terminals, and it uses an insulating plate which pre-tensions the blades to provide for contact blade dampening to achieve low contact bounce. The improved switch design permits housing of an illuminating light therein without altering the contact configuration or the interchangeability of the same for key top illumination and facilitates ready relamping of the switch without removal of the switch from the circuit board or disassembly of the switch except for removal of the button. The improved switch design is a low cost, economical structure which is readily modified by an interchange of actuator plungers to provide the various contact configurations or by rotation of the plunger and housing assembly to provide a variation in the switching configuration without the disassembly and removal of the switch base from the printed circuit board to facilitate circuit change over and variation.

Therefore, it is the principal object of this invention to provide an improved push-button electric switch which may be altered in circuit configuration by a change in relation of parts thereof without removal of the switch base from a mounted condition.

Another object of this invention is to provide an improved push-button switch in which various circuit configurations may be obtained therefrom.

Another object of this invention is to provide an improved switch design which facilitates the use of single pole or double pole, single throw switching configuration through variation in bridging contacts.

A further object of this invention is to provide a switch of this type which is readily mountable upon a printed circuit board through high speed assembly and which may be modified by removal of the covering housing and plunger assembly to facilitate fast and easy assembly and change in switch function.

A still further object of this invention is to provide an improved push-button switch which has a long life.

Another object of this invention is to assemble an insulating plate in such a relationship to the contacting bifurcated wiping blades so that blades are pre-tensioned with enough force to exceed any possible combination of physical characteristics of mass, velocity, and reflected energy that would cause the closing contacts to bounce open on initial closure.

A further object of this invention is to provide projections on the housing to project through holes in a printed circuit board to key the plunger and housing assembly to the printed circuit board so the contacting bifurcated wiping blades can contact directly on the printed circuit board conducting surface.

Another object of this invention is to provide an improved switch configuration which includes a provision for mounting of an illumination light therein.

These and other objects of the invention will become apparent from reading of the attached description together with the drawings wherein.

Figure 7:
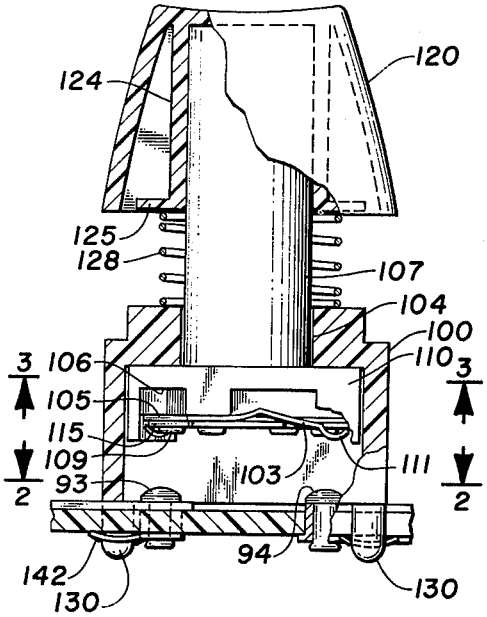
FIG. 7 is a side elevation view of an alternate embodiment of the switch in the present invention with parts broken away.
Figure 10:
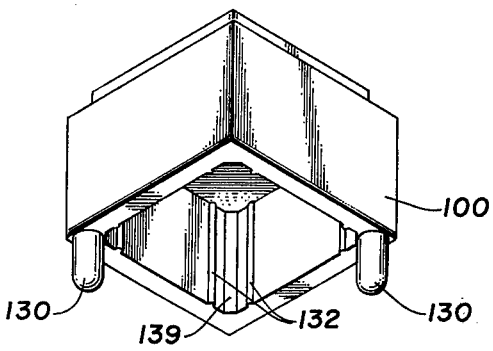
Figure 9:
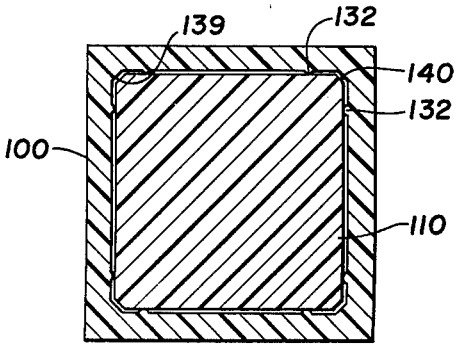

FIG. 9 of a sectional view of the switch of FIG. 7 taken along the lines 3—3 therein; and, FIG. 10 is a perspective view of the switch housing of the embodiment of FIG. 7.

Figure 1:
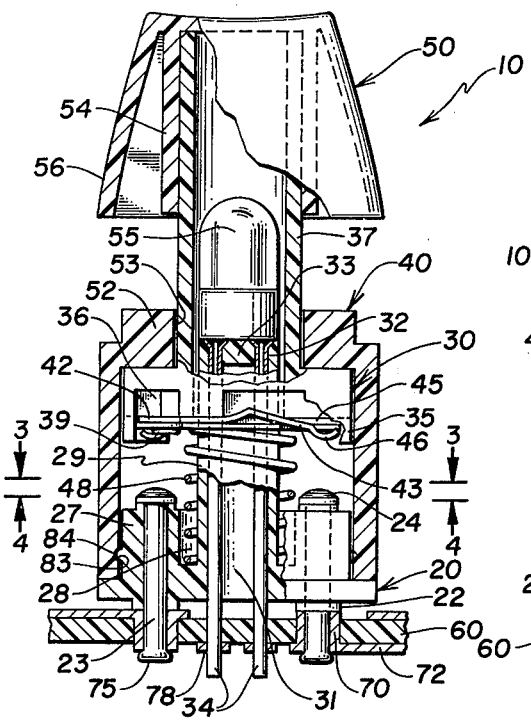
FIG. 1 is a side elevation view of a switch made according to the present invention and with parts cut away and in an unactuated position.
Figure 2:
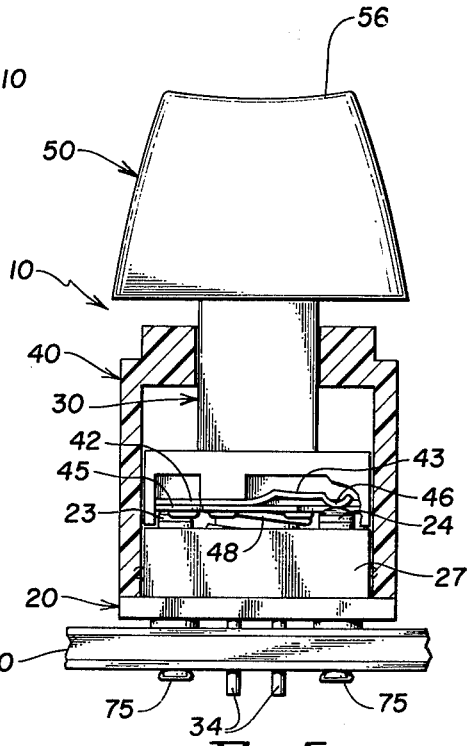
FIG. 2 is a side elevation view of the switch of FIG. 1 as applied to a printed circuit board and with the push button advanced to an actuated position and parts cut away to show relationship of the same.

My improved push-button switch design is shown in an assembled relationship in FIG. 1 and 2 generally at 10. The switch design includes basically a base member, indicated generally at 20, an actuating plunger, indicated generally at 30, with a cover member or housing indicated generally at 40, and a button 50 positioned on the end of the actuating plunger and exposed beyond the cover member. The contact means of the switch, as will be hereinafter identified, are incorporated in part on the actuating plunger and the base member. In FIGS. 1 and 2, the switch is shown mounted on a printed circuit board, indicated generally at 60.

Figure 3:
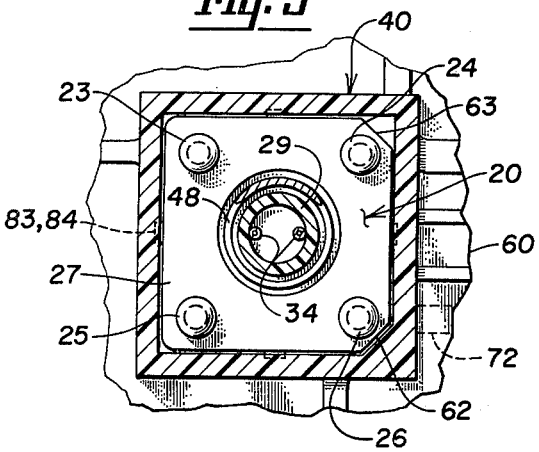
FIG. 3 is a sectional view of the switch of FIG. 1 taken along the lines 3—3 therein and showing the base member of the improved push-button switch.

Base member 20, as will be seen in FIG. 3, is generally rectangular in cross-section, having a lower surface with terminal stand off bus hubs 22 protruding therefrom through which terminals 23–26 extend. The upper surface of the base member has a generally rectangular raised portion 27 with an angular groove 28 positioned therein and with an upstanding hollow post section 29 projecting therefrom. The terminals 23–26 extend through the base and hub 22 from the upper surface of the raised portion 27 and have rivet type contacts heads exposed on the upper surface of the same. The post section 29 of the base has a cylindrical recess 31 extending from the lower surface thereof with the upper surface being solid as at 32 and having a pair of passages 33 therein in which are positioned a pair of conductive electrode connector members 34 for purposes to be later noted. These extend through the recesses 33 in the upper surface 22 of the post section and through the recessed interior 31 below the base surface. As indicated in FIGS. 1 and 2, the terminals are adapted to extend through the terminal board or printed circuit board 60. The base is made of a suitable insulating material and the terminal members 23–26 extend through the hubs 22 on the lower surface of the same and through a printed circuit board 60 in the manner to be later defined.

The actuating plunger 30 of the switch has a generally rectangular head portion 35 with a hollow square shaft portion or member 37 extending upward therefrom. The opposite surface of the head 35 has recesses 36 therein and extended contact mounting pins 38 which flatten, as at 39, to secure contact plates and blades dampening plates thereon. Also positioned on the under surface of the head 35 of the actuating plunger 30 is a contact plate 42 which has a body portion with bifurcated wipers 43 extending from opposite sides thereof and in respective opposite directions. The contact plate has apertures 44 therein which fit over the pins 38 and mount the contact plate 42 in an orientation wherein the bifurcated wiper portions 43 are positioned over the recesses 36 in the under surface of the head 35. A generally cruciformed shape insulating dampening plate 45 with apertures therein is mounted on the top of the contact plate 42 on the pins 38, and overlies the contact plate 42 covering the body portion thereof. The edges on the dampening plate on two sides thereof overly the bifurcated wipers along the extent of the same to bias the wipers and reduce the bounce of the same. The wiper portions 43 are bent at an angle to the body 42 and have curved contact extremities 46 at the free ends of the same. The insulating dampening plate is assembled in such a relationship to the contacting bifurcated wiping blades so the blades are pre-tensioned with enough force to exceed any possible combination of physical characteristics of mass, velocity and reflected energy that would cause the closing contacts to bounce open on initial closure. As will be indicated in FIGS. 4, 5, and 6, one or two such plates with insulating dampening plates 45 may be positioned on the under surface of the head to contact the terminals 23–26. A helical spring 48 as positioned in the recess 28 in the upstanding portion 27 of the base member with the opposite extremity bearing against the insulating dampening plate 45 of the contact assembly and against the under surface of the head 35 of the actuating plunger to bias same in the retracted position wherein the curved contact tips 46 of the contact plate or plates 42 are out of contact with the terminals 23–26.

Positioned over the plunger 30 is the housing 40 which is generally rectangular in cross section having a recess to fit over the raised base portion 27 to permit reciprocation of the head portion 35 of the plunger. The housing has a generally raised top 52 with a square opening 53 through which the generally square plunger shaft portion 37 extends. Within the hollow shaft portion of the plunger is positioned an indicating light 55 whose connecting electrodes or terminals (not shown) extend through and contact the tubular members 34 positioned in the post 29 of the base member to provide an electrical connection through the insulated post and base 20 to the printed circuit board. The push-button cover or push-button has a generally rectangular flanged opening 54 fitting over the end of the shaft portion 37 of the plunger for the purpose of reciprocating the same up and down to bring the contacts 42 into the engagement with the terminals 23–26. The push-button has a curved upper surface 56 and is translucent to permit the light indication from the light 55 to eminate therefrom. Housing member 40, as well as the actuating plunger 30 and the base member 20 are all made of an insulating plastic material which may take varying forms. The contact member or members will be suitable metallic contact material, such as alloys of copper with the terminals of the same construction, and precious metal outer plating.

Figure 4:
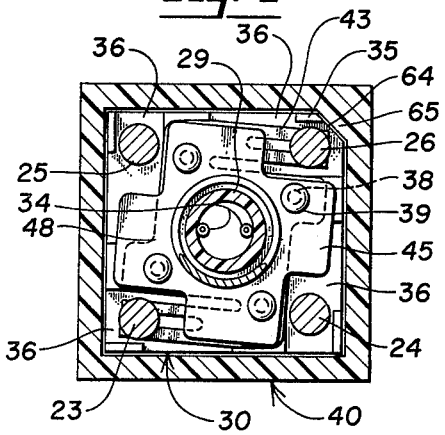
FIG. 4 is a sectional view of the switch of FIG. 1 taken along the lines 4—4 therein and showing one contact configuration with the base member.
Figure 5:
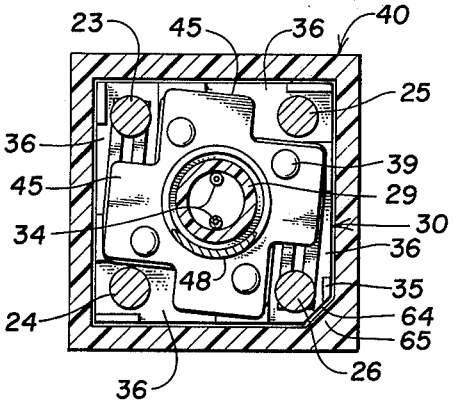
FIG. 5 is a sectional view similar to FIG. 4 and showing an alternate contact orientation with the base member.

As will be seen in FIG. 3, the raised portion of the base has two corners relieved as at 62, 63, to provide a keying relationship between the housing and base as will be hereinafter identified. The head portion 35 of the actuating plunger has a similar relieved corner 64 and the housing has one corner of the generally rectangular recess which does not come to a 90° angle but rather provides a mating surface, as indicated at 65, to fit over but provide clearance with the relieved portion 64 on the head and to cooperate with either of the relieved corners 62, 63, of the upstanding portion 27 of the base. Thus, as will be seen in FIG. 4, the sectional view shows the exposed contact terminals 23–26 of the base member with the wiper portions 43 of the contact plate 42 are in contact with the terminals 24 and 25. Its second orientation, as seen in FIG. 5, is affected by rotating the actuating plunger and housing relative to the base member through a 90° relationship will bring the terminals 23 and 26 into contact with the wiper portions 43 of the contact plate 42 to provide a different circuit configuration for the switch with the terminal board or printed circuit with which it is associated.

Figure 6:
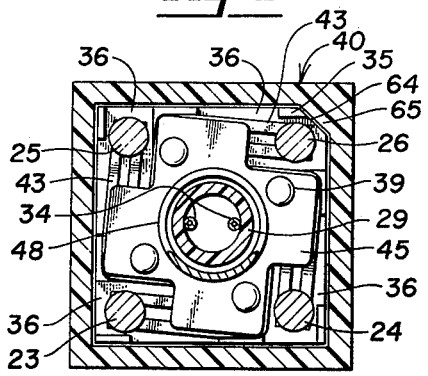
FIG. 6 is a sectional view of the switch of FIG. 1 similar to FIG. 4 and showing a second contact configuration for the switch.

In addition, as will be seen in FIG. 6, two such contact plates 42 with their respective wiper portions 43 may be mounted on the head with a dividing insulating plate 45 positioned therebetween and with another insulating plate 45 covering the lower contact plate to provide a stacked relationship of contact plates and insulating plates on the under surface of the head 35 of the actuating plunger. This will provide a contact configuration in which all four terminals 23–26 are contacted simultaneously with a circuit being made through the terminals 24, 25, and 23, 26, simultaneously with depression of the actuating plunger from the push-button switch. The insulating dampening plates 45 have portions of the cruciformed edges of the same, as will be best seen in FIGS. 4, 5, and 6, bearing against the bifurcated wiper portions 43 of the contact plates to apply a bias against the same to reduce bounce of the contacts upon depression of the actuating plunger. Similarly, the recessed surfaces 36 in the head which underlie the wiper portions or bifurcated wiper blades 43 permit flexure of the wiper blades as they contact the terminals 23–26 to prevent interference of the same with the undersurface of the head 35 of the actuating plunger.

As will be best seen in FIGS. 1 and 2, the printed circuit board with which such a push-button switch is normally associated, will be provided with conductive type mounting holes 70 connected to portions of the printed circuit on the board, as indicated at 72, so that the terminals extending beyond the insulating hubs of the base member 20 will extend through the connectors 70 on the printed circuit board and be rounded off or suitably riveted, as at 75, to secure the base permanently to the printed circuit board. Similarly, in the illuminated switch, the conductive tubes which frictionally mount the wires or leads from the bulb 55 may be suitably connected to portions of the printed circuit, as indicated by the conductive portions 78 thereon. All mechanical connections are further soldered for suitable electrical contact. The assembly of the parts of the push-button switch includes a protruding detent portion 82 on the sides of the raised portion 27 of the base member which fit into suitable grooves 83 in the inner surface of the housing member and on three sides thereof so that the housing may be frictionally latched or connected to the base member and enclose the head portion of the actuating plunger therein. The plunger assembles within the housing in only one position due to the keyed surfaces or relieved corner and filled corner of the housing. However, the housing member or overall housing 40 assembles on the base member in any one of two positions, such as is indicated in FIGS. 4 and 5, and this will permit orientation of the contact plate 42 and the wiper portions 43 thereof to provide for two different circuit relationship between the four terminals 23–26 positioned in the base member and connected to the printed circuit. Thus, after installation, the switch configuration may be altered by removal of the housing rotation of the housing and actuating plunger on the base member 20 to provide for either of these circuit configurations. This will provide for single pole, single throw circuit of a second terminal configuration. Similarly, by the use of two contact plates 42 separated and insulated from one another, the bridging contact relationship of the wiper portions thereof with the respective terminals may provide for a double pole, single throw type push button switch completing both of the two circuits on the printed circuit board independently from each other. In addition, and depending upon the circuit configuration of the board, one such terminal can be a common electrode or conductor in the printed circuit with the remaining three terminals providing different circuits for suitable binary counting.

The eyelet or rivet type assembly of the base on the printed circuit board provides for high speed automated assembly and the housing, and plunger assembly snaps onto the base to facilitate fast and easy assembly and a switch function change without having to disassemble the switch and remove the same from the printed circuit board. It also permits cleaning of the board after assembly and before the switch is completely assembled to protect delicate switch parts during cleaning. The insulated cruciform dampening plates 45 provide a dampening action on the bifurcated wiper portions 43 of the contact plates 42 to achieve low contact bounce due to pretension of the blades against the dampening plates. The bifurcated wiper portions insure a longer switching life through the use of a redundancy of two by paralleling inputs and outputs. The separate blades or wiper portions of the contact plates achieve various contacting combinations, as referred to above, and the various normally open contact configurations simplify encoding techniques in the printed circuit board. The improved switch design further permits the insertion of an illumination bulb within the assembly for key top illumination without altering the switching characteristics or combinations. Relamping is available from the top of the assembly by removal of the button and the bulb therefrom. The post type terminals in the switch further permit customer insertion of the switches in a printed circuit board and varying type of connections thereto may be utilized from the standpoint of securing the switch to the printed circuit board and the electrical connections to the terminals.

Figure 8:
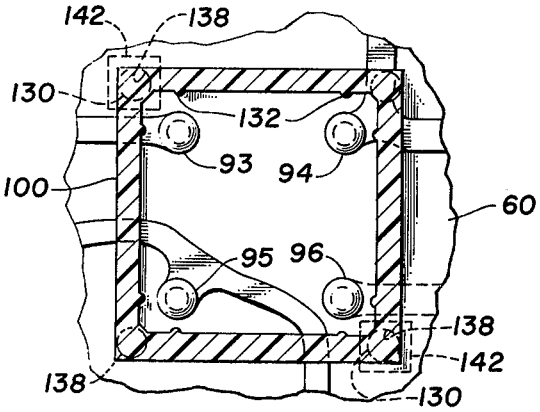
FIG. 8 is a sectional view of the switch of FIG. 7 taken along the lines 2—2 therein.

In the embodiment shown in FIGS. 7 and 8, the push-button electric switch is modified to eliminate the base member 20 so that the switch contacts on the plunger may cooperate with contact elements affixed to the printed circuit board and made a part thereof. Thus, as will be seen in FIGS. 7 and 8, the printed circuit board 60 has mounted thereon contact terminals 93, 94, 95 and 96, which will be connected in circuit on the board or omitted from circuit depending upon the desired switching configuration for the overall circuit. The housing 100 in this embodiment takes the overall shape as in the previous embodiment including the square opening 104 in the upper surface thereof through which the stem or body of the plunger or actuator 107 extends. The head 110 of the actuating plunger remains unchanged in shape with suitable recesses 106 and with the posts 109 mounting the contact plate 105 with bifurcated wipers 103 extending from the body of the plates. The wipers have the curved extremities 111 which contact the contact members 93–96 on the printed circuit board in a conventional manner and the insulated dampening plate 115 is positioned over the contact plate to mount the same on the head of the actuator and on the under surface thereof prebiasing the bifurcated wiper blades 103.

In the embodiment shown herein, the stem of the actuator is solid, although it may be made hollow to permit the mounting of a suitable light (not shown) on the circuit board and the extension of the same into the hollow recess of the actuating plunger. The button 120 mounting on the end of the plunger fits over the end thereof with its suitable square portion 124 sliding on the body of the stem and including friction gripping members (not shown) to prevent movement of the same under the presence of spring pressure which will be later noted. The button has a flanged portion 125 extending at the end of the cylindrical mounting portion 124 which forms a retainer for the bias spring 128 which bears against the flange 125 and the upper surface of the housing 100 surrounding the stem to bias the plunger in a retracted position.

The lower surface or open surface of the housing is positioned or mounted directly on the printed circuit board 60 and suitable projections or pins 130 extend from two corners thereof as seen in FIG. 10 for locating the housing on a printed circuit board. Interior of the housing are guide ridges 132, as seen in FIGS. 8 and 9, extending along the inner surface of the same which contact and guide the head 110 of the actuating plunger 107 and reduce frictional engagement between the plunger and the housing as the same is reciprocated. The printed circuit board will have an arrangement of varying mounting holes 138 therein which may be equipped with suitable friction gripping devices (not shown) to provide the housing with a plug-in type of installation. By orienting the housing with the plunger therein on the printed circuit board and with respect to the contacts positioned on the surface thereof, the wiping contacts of the actuating plunger may be oriented to contact different pairs of contacts on the printed circuit board in the manner described in the embodiments shown in FIGS. 4 and 5. Similarly, a pair of contact plates may be mounted on the contacting plunger and all contacts 93–96 on the printed circuit board may be engaged simultaneously. The housing includes different sized beveled corners 139 on the interior surface thereof. Proper mating of the beveled recessed corners 140 on the actuating head of the plunger will orient the same in a predetermined manner with the housing 100 and further provides for the construction of the mounting pins 130 for the housing on the printed circuit board. In this embodiment, as in the preferred embodiment, an indicating light may be utilized with the switch, the indicating light being mounted directly on the printed circuit board and positioned through the hollow stem of the actuating plunger (not shown) to provide the same cooperation and illumination of the push-button switch. Similarly, the switch may be oriented on a printed circuit board with respect to the contacts thereof to provide the varying switch and configurations described above.

Therefore, in considering the present invention, it should be remembered that the present disclosure is illustrative only and the scope of the invention should be determined by the appended claims.

What I claim is:

1. A push-button electric switch comprising, a base member having a lower surface adapted to rest on a circuit board, said base member having a center guide post and a raised upper surface with contact terminals positioned in said raised upper surface and extending through the base member being exposed on the upper surface, an actuating plunger having a head symmetrical with the raised upper surface of the base member and a hollow shaft section adapted to be positioned over the center guide post of the base for reciprocal movement thereon, contact means positioned on the under surface of the head having common wiper members adapted to contact diametrically positioned terminals in the base member, housing means having a center recess positioned over the acturating plunger and the raised upper surface of the base member with the center opening providing passage for the shaft section of the actuating plunger, means included in part on the housing means and in part on the base member to releasably secure the housing means to the base member, and key means positioned in part on the raised upper surface of the base member and in part on the head of the actuating plunger and on the housing means to permit the actuating plunger to be rotated a predetermined rotation with respect to the base member and bring the contact means on the head of the plunger into engagement and selectively with two pair of diametrically positioned terminals in the base member.

2. The push-button electric switch of claim 1 in which the key means is an irregular surface positioned at two points on the raised upper surface of the base member and at a single point in head of the plunger member and and in the housing means.

3. The push-button electric switch of claim 1 and including spring bias means positioned around the post of the base member and engaging the hollow shaft section of the plunger to bias the plunger to a position where the contact means on the head are displaced from the terminals on the base member.

4. The push-button electric switch of claim 1 in which the means positioned in part on the housing and in part on the base member are a cooperating detent and a recess to frictionally secure the housing means on the base member selectively.

5. The push-button electric switch of claim 1 in which the center guide post of the base member and the shaft section of the actuating plunger are hollow and adapted to position a light bulb with energizing terminals thereof extending through the base member.

6. The push-button electric switch of claim 1 and including button means positioned on the top of the hollow shaft of the actuating plunger for reciprocating the same.

7. The push-button switch of claim 1 in which the base member and the raised upper surface thereof are generally rectangular in cross section with the same shape for the head of the actuating plunger and the interior of the housing means to telescopically fit the housing means over the actuating plunger and the interior of the housing means to telescopically fit the housing means over the actuating plunger and the raised inner surface of the base member, and in which the key means is a relieved corner on two of the corners of the raised upper surface of the base member and one corner of the rectangular head of the actuating plunger and the housing member to permit rotation of the actuating plunger to vary the pair of contact terminals in which the contact means contact.

8. The push-button electric switch of claim 7 in which the contact means has two pair of bridging contacts thereon separated from one another by an insulating plate and with a pair of actuating fingers on each of the bridging contacts adapted to contact pairs of terminals on the base member.

9. The push-button electric switch comprising, a base member having a center post and a raised upper surface with contact terminals positioned in the raised upper surface and extending through the base member, and said base member being made of an insulating material and having terminal insulating hubs on the lower surface adapted to contact the rest on a circuit board for mounting of the switch thereon, an actuating member having a head symmetrical with the raised upper surface of the base member and a hollow shaft section adapted to be positioned over the post of the base member to permit movement of the plunger thereon, said actuating plunger being made of an insulating material and mounting contact means on the under surface thereof, said contact means having common wiper members adapted to contact diametrically positioned terminals in the base member, a housing of insulating material having a center recess positioned over the actuating plunger and the raised upper surface of the base member with a center opening providing a passage for the shaft section of the actuating plunger, irregular corners positioned on two of the corners of the raised upper surface of the base member and on one of the corners of the head of the actuating plunger and the inner surface of the housing member, means included in part in the housing means and in part in the base member to releasably secure the housing means on the base member with the irregular corners providing an assembly of the actuating plunger and the housing in only one position and the housing with the actuator therein on the base member in either of two positions, and bias means positioned on the center post of the base member and contacting the plunger to bias the actuating plunger to a position in which the contact means are out of contact with the terminal in the base member.

10. The push-button electric switch of claim 1 in which the base member, actuating plunger and housing member are made of an insulating plastic material.

11. The push-button electric switch of claim 5 and including tubular conductor means positioned in the center post of the base member and adapted to mount the energizing terminals of the light bulb.

12. The push-button electric switch of claim 9 in which the contact means mounted on the head of the actuating plunger includes two bridging contacts with wiper portions extending on opposite sides thereof with wiper portions insulated from one another, and in which the terminals in the base member include terminals at four corners thereof adapted to be contacted by the wipers of the contact means to provide a pair of insulated circuits therethrough.

13. The push-button electric switch of claim 9 in which the contact means mounted on the head of the space member includes a single bridging contact member with a pair of wiper members on opposite sides thereof and in which the orientation of the housing means with the actuating plunger therein on the base member selectively in two positions of the assembly will provide selective contact with two pair of diametrically positioned terminals in the base member.

14. The push-button electric switch of claim 1 and including a cruciform shaped insulating plate positioned over the contact-means with opposite edges overlying and engaging the wiper members under tension to dampen movement of the same.

15. The push-button electric switch of claim 9 and including an insulating plate having edges which overlay and engage under tension the wiper members and to dampen the movement of the same.

16. A push-button electric switch adapted to be mounted on a base surface associated with a circuit board with contact terminals positioned in said base surface comprising, an actuating plunger having a head, contact means positioned on the under surface of the head with the contact means having common wiper members adapted to contact diametrically positioned terminals in the base surface, housing means having a center recess positioned over the actuating plunger and enclosing the head of the plunger, said housing means being adapted to be mounted on and secured to the base surface of the circuit board, means including in part in the housing means and in part in the head of the plunger to guide the plunger for movement in a predetermined relationship with respect to the housing means, and key means positioned in part on the base surface and in part on the housing means to permit the actuating plunger and the housing means to be rotated a predetermined rotation with respect to the base surface and secured thereon to bring the contact means on the head of the plunger, and to engage selectively with a pair of diametrically positioned terminals in the base surface.

17. The push-button switch of claim 16 and including bias means associated with the plunger for positioning the plunger in a predetermined relationship with respect to the housing means.

18. The push-button switch of claim 17 in which the spring bias means is positioned between the plunger and the housing means.

19. The push-button switch of claim 16 in which the key means positioned in part on the base surface and in part on the housing means are prong members projecting from the lower surface of the housing means and cooperating recessed surfaces in the base surface.

* * * * *